United States Patent [19]

Nagata et al.

[11] Patent Number: 5,031,650

[45] Date of Patent: Jul. 16, 1991

[54] DISHWASHING MACHINE

[75] Inventors: Osamu Nagata, Toyoake; Tokihiro Kuwahara, Kariya; Naomoto Amano, Okazaki, all of Japan

[73] Assignee: Hoshizaki Denki Kabushiki Kaisha, Toyoake, Japan

[21] Appl. No.: 487,321

[22] Filed: Mar. 2, 1990

[30] Foreign Application Priority Data

Mar. 3, 1989 [JP] Japan ..... 1-52474
Aug. 25, 1989 [JP] Japan ..... 1-99301[U]

[51] Int. Cl.[5] ..... B08B 3/02

[52] U.S. Cl. ..... 134/111; 134/104.4; 134/110; 134/104.2; 210/421

[58] Field of Search ..... 134/111, 110, 109, 104.4; 210/421, 420, 341, 340

[56] References Cited

U.S. PATENT DOCUMENTS

| | | | |
|---|---|---|---|
| 2,439,535 | 4/1940 | Wilson | 134/111 |
| 2,657,697 | 11/1953 | Walker | 134/111 |
| 3,949,772 | 4/1976 | Hartmann | 134/111 |
| 3,989,054 | 11/1976 | Mercer | 134/104.4 |
| 4,004,600 | 1/1977 | Crow | 134/111 |
| 4,039,005 | 8/1977 | Clifford | 134/104.4 |
| 4,392,891 | 7/1987 | Meyers | 134/104.4 |

FOREIGN PATENT DOCUMENTS 63-143265 9/1988 Japan .

*Primary Examiner*—William A. Cuchlinski, Jr.
*Assistant Examiner*—William C. Dowling
*Attorney, Agent, or Firm*—Armstrong, Nikaido, Marmelstein, Kubovcik, & Murray

[57] ABSTRACT

A dishwashing machine has a washing chamber, a wash tank formed at a bottom of the washing chamber to store an amount of hot wash water therein, a wash pump mounted to a bottom portion of the wash tank, and a pair of upper and lower wash arms arranged to apply jet streams of the hot wash water supplied thereto from the pump over a rack of dishes placed in the washing chamber, wherein a strainer box is mounted within an upper portion of the wash tank to receive the wash water flowing down from the rack of dishes during washing operation and associated with a side wall of the wash tank to form an opening in communication with the bottom portion of the wash tank, the strainer box having a bottom in communication with a drain pipe to permit the flow of wash water drained therethrough, and wherein a distribution plate is arranged to receive the wash water and introduce it into the strainer box when placed in a first position and to receive the wash water and introduce it into the bottom portion of the wash tank through the opening when placed in a second position.

4 Claims, 3 Drawing Sheets

DISHWASHING MACHINE

BACKGROUND OF THE INVENTION

1. Field of the Invention

The present invention relates to a dishwashing machine, more particularly to an improvement of a dishwashing machine wherein the racked dishes are washed and rinsed by spray of hot water.

2. Discussion of the Prior Art

In conventional dishwashing machines of the commercial spray-type, hot wash water is drawn from a wash tank at the bottom of the washing chamber and supplied to upper and lower wash arms in the washing chamber by means of a circulation pump mounted to the wash tank. The hot wash water is sprayed by rotation of the wash arms over the racked dishes in the washing chamber and is circulated into the wash tank. Subsequently, fresh hot rinse water is further supplied to the wash arms and sprayed over the dishes therefrom. The hot rinse water is also circulated into the wash tank, and the rinse water excess in amount is drained through an overflow pipe in the wash tank. In conventional dishwashing machines of the domestic or houshold type, hot wash water is drawn from a wash tank at the bottom of the washing chamber and supplied to upper and lower wash arms in the washing chamber by means of a circulation pump mounted to the wash tank. After being sprayed over the racked dishes in the washing chamber, the hot wash water is circulated into and drained from the wash tank. Subsequently, fresh hot rinse water is supplied into the wash tank and is drawn from the wash tank to the wash arms by means of the circulation pump. After sprayed over the racked dishes, the hot rinse water is circulated into the wash tank.

In the dishwashing machine of the commercial spray-type, the hot wash water is contaminated by food soils and cooking oil released from the dishes at an initial stage of the washing operation and circulated into the wash tank. With the contaminated wash water, the food soils of the dishes become difficult to remove. Assuming that glasses have been placed in the washing chamber after washing of dishes soiled with curry, the glasses will be soiled with the contaminated wash water. At the initial stage of the washing operation, the dishes absorb the heat of wash water sprayed thereon to cause fall of the temperature of wash water circulated into the wash tank. As a result, the hot wash water may not be maintained at a proper temperature required for sanitarily washing the dishes. In the dishwashing machines of the domestic type, the contamination of the wash water can be avoided but the temperature of wash water in the wash tank falls below the proper temperature.

SUMMARY OF THE INVENTION

It is, therefore, a primary object of the present invention to provide an improved dishwashing machine wherein the contamination of wash and rinse water can be avoided without causing the temperature fall of wash and rinse water.

According to the present invention, the object is attained by providing a dishwashing machine which includes a washing chamber having a bottom, a wash tank formed at the bottom of the washing chamber to store an amount of hot wash water therein, a wash pump mounted to a bottom portion of the wash tank to pump up the hot wash water therefrom, and means for applying jet streams of the hot wash water supplied thereto from the wash pump over a rack of dishes placed in the washing chamber, wherein a strainer box is mounted within an upper portion of the wash tank to receive the wash water flowing down from the rack of dishes during prewashing operation and associated with a side wall of the wash tank to form an opening in communication with the bottom portion of the wash tank, the strainer box having a bottom in communication with a drain pipe to permit the flow of wash water drained outwardly therethrough, and wherein a distribution plate is arranged to receive the wash water and introduce it into the strainer box when placed in a first position and to receive the wash water and introduce it into the bottom portion of the wash tank through the opening when placed in a second position.

BRIEF DESCRIPTION OF THE DRAWINGS

Additional objects, features and advantages of the present invention will be more readily appreciated from the following detailed description of preferred embodiments thereof when taken together with the accompanying drawings, in which.

DESCRIPTION OF THE PREFERRED EMBODIMENTS

Figure 1:
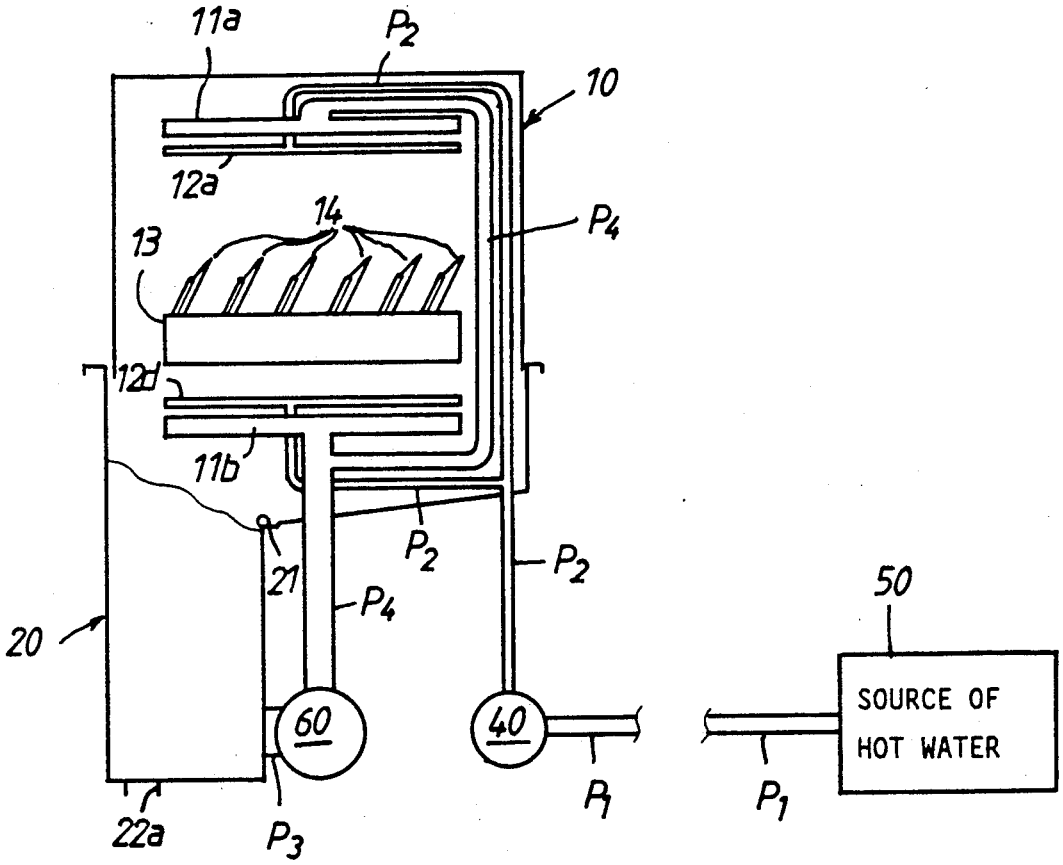
FIG. 1 is a partly broken schematic illustration of a dishwashing machine of the commercial spray-type incorporating the preferred embodiment of the present invention.
Figure 2:
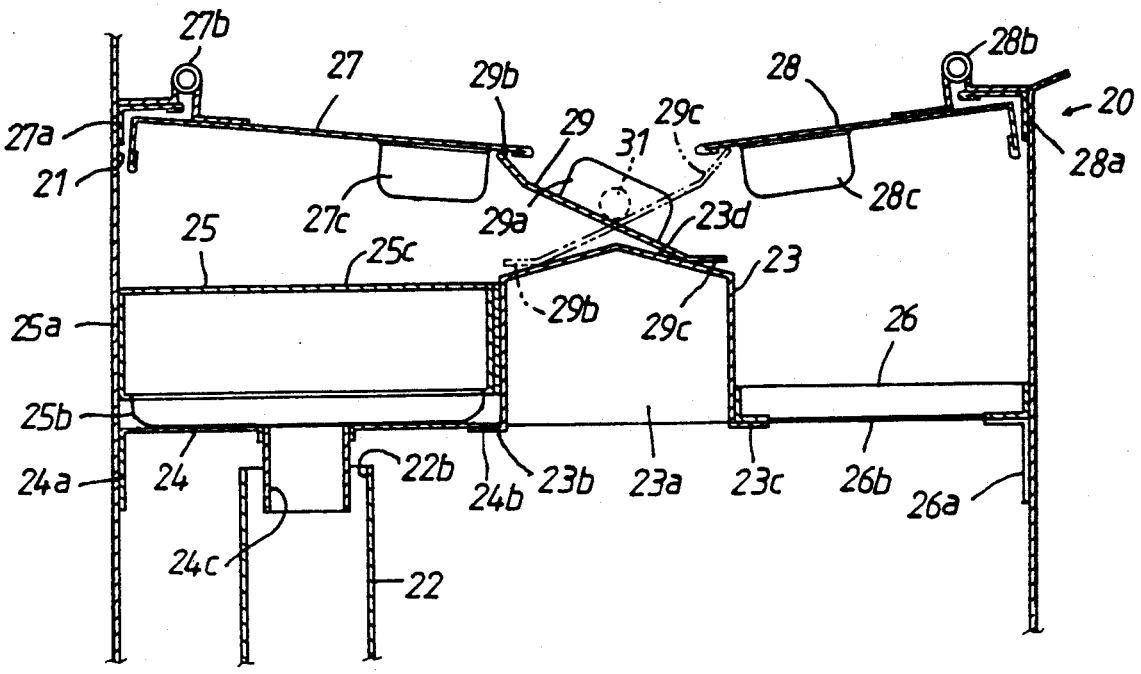
FIG. 2, is an enlarged sectional view of a wash tank of the dishwashing machine shown in FIG. 1.

In FIG. 1 of the drawings, there is schematically illustrated a dishwashing machine of the commercial spray-type which has a washing chamber 10 provided therein with a pair of upper and lower wash arms 11*a*, 11*b* and a pair of upper and lower rinse arms 12*a*, 12*b*. The wash and rinse arms 11*a*, 11*b* and 12*a*, 12*b* are arranged to oppose dishes 14 in a rack 13 placed in the washing chamber 10. A wash tank 20 is formed at the bottom of washing chamber 10 and opens at 21 into the interior of washing chamber 10 to accommodate a desired amount of hot water therein. Disposed within the wash tank 20 is an overflow pipe 22 which extends upward from a bottom of wash tank 20 as shown in FIG. 2. As shown in FIG. 1, the overflow pipe 22 has a lower end 22*a* which extends downward through the bottom of wash tank 20.

As shown in FIG. 2, the wash tank 20 has an upper portion provided therein with a transverse partition wall 23 which is made of sheet metal to form a roof of trianglur cross-section. The transverse partition wall 23 is horizontally located at the center between a pair of side walls of the wash tank 20 and secured at its opposite ends 23*a* to front and back walls of the wash tank 20. Arranged at the left side of partition wall 23 is a horizontal support plate 24 which is secured at its left side 24*a* to the left-hand side wall of tank 20 and at its right side 24*b* to a left-hand lower flange 23*b* of partition wall 23. The horizontal support plate 24 is located just above the overflow pipe 22 and is integrally provided at its central portion with a drain pipe 24c which extends into the upper end 22b of overflow pipe 24. Placed on the support plate 24 is a strainer box 25 which is composed of an open top frame 25a of rectangular in shape and a mesh filter 25b secured at its outer periphery to the bottom of frame 25a. The strainer box 25 has a grip member 25c which is located at the center of frame 25a in a fore-and-aft direction and secured at its opposite ends to a pair of side walls of frame 25a. The strainer box 25 is removably supported on the support plate 24 in such a manner that the upper end of frame 25a is positioned slightly below the left-hand upper end of partition wall 23 and that the mesh filter 25b is in contact with the upper surface of support plate 24 to cover the upper end of drain pipe 24c.

Arranged at the right side of partition wall 23 is a scrap tray 26 which is horizontally supported on a right-hand lower flange 23c of partition wall 23 and a L-letter shaped bracket 26a secured to the right-hand side wall of wash tank 20. The scrap tray 26 is provided at its bottom with a mesh filter 26b. Arranged just above the strainer box 25 is a guide plate 27 which is hinged at 27b to an L-letter shaped bracket 27a secured to the left-hand side wall of wash tank 20. The guide plate 27 extends downwards toward the partition wall 23 to cover the strainer box 25 and is detachably fixed at its flange 27c to the back wall of wash tank 20. In this arrangement, the inner end of guide plate 27 is spaced upward from the left end of upper part 23d of partition wall 23. Arranged just above the scrap tray 26 is a guide plate 28 which is hinged at 28b to an L-letter shaped bracket 28a secured to the right-hand side wall of wash tank 20. The guide plate 28 extends downwards toward the partition wall 23 to cover the scrap tray 26 and is detachably fixed at its flange 28c to the back wall of tank 20. The inner end of guide plate 28 is spaced upward from the right end of upper part 23d of partition wall 23 and spaced from the inner end of guide plate 27.

A distribution plate 29 is arranged in a space between the guide plates 27, 28 and the upper part 23d of partition wall 23 and extends in parallel with the upper part 23d of partition wall 23 between the front and back walls of tank 20. The distribution plate 29 has an L-letter shaped flange 29a which is secured to a rotary shaft 31 for rotation therewith. When the rotary shaft 31 is rotated counterclockwisely, the distribution plate 29 is placed in a first position shown by imaginary lines in FIG. 2. When the rotary shaft 29 is rotated clockwisely from the first position, the distribution plate 29 is placed in a second position shown by solid lines in FIG. 2. The distribution plate 29 is bent upward at its opposite ends 29b, 29c. When placed in the first position, the distribution plate 29 is engaged at its left end 29b with the left-hand upper part 23d of partition wall 23 and at its right end 29c with the inner end of guide plate 28. When placed in the second position, the distribution plate 29 is engaged at its left end 29b with the inner end of guide plate 27 and at its right end 29c with the right-hand upper part 23d of partition wall 23.

Figure 3:
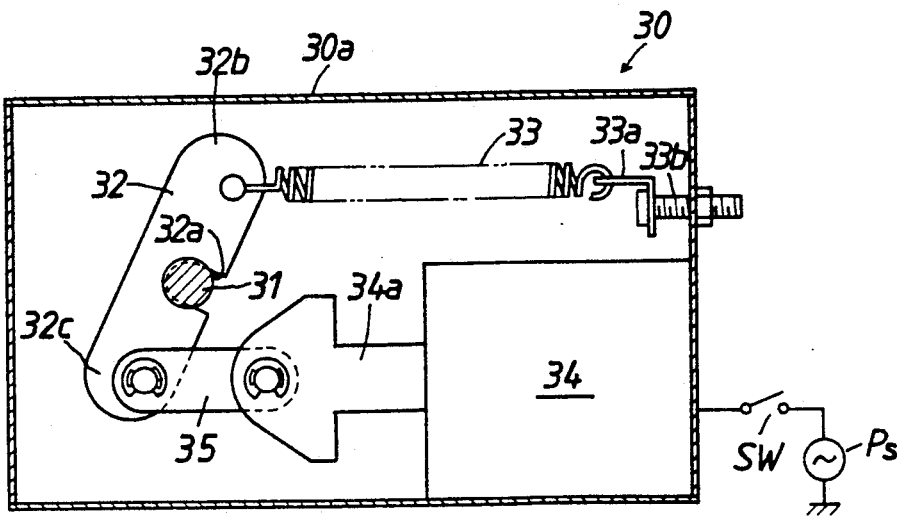
FIG. 3 is an enlarged sectional view of a changeover mechanism mounted to a side wall of the wash tank.

As shown in FIG. 3, a changeover mechanism 30 includes a casing 30a of rectangular in shape attached to the back wall of wash tank 20. The rotary shaft 31 is rotatably mounted within the casing 30 and extended into the interior of wash tank 20 for connection to the L-letter shaped flange 29a of distribution plate 29. A rotary lever 32 is coupled with the rotary shaft 31 at its recess 32a for rotation therewith and is connected at its upper end portion 32b to one end of a coil spring 33 which is engaged at its other end with a hook 33a to bias the rotary lever 32 clockwisely. The hook 33a is carried by a bolt 33b fastened to the right-hand side wall of casing 30a. A linear actuator 34 mounted within casing 30a has a movable rod 34a which is connected to a lower end 32c of rotary lever 32 by means of a link lever 35. In a condition where the linear actuator 34 is deactivated, the movable rod 34a is retained in a first position shown in FIG. 3. When the actuator 34 is activated, the movable rod 34a is attracted by energization of a solenoid in the actuator 34 against the biasing force of coil spring 33 to rotate the rotary lever 32 counterclowisely. The solenoid in actuator 34 is connected to an electric power source Ps through a manual switch SW to be applied with the electric power when the switch SW has been closed.

As shown in FIG. 1, the wash arms 11a, 11b are connected to a wash pump 60 by means of conduits $P_4$, while the rinse arms 12a, 12b are connected to a rinse pump 40 by means of conduits P2. The wash pump 60 is mounted to the wash tank 20 through a pipe $P_3$ and is driven by an integrally mounted electric motor (not shown) to pump up hot wash water from the bottom of wash tank 20 and supply it to the wash arms 11a, 11b through conduits $P_4$. The wash arms 11a, 11b rotate to spray jet streams of hot wash water onto the racked dishes 14 in the washing chamber 10. After sprayed, the wash water flows into the wash tank 20 through the space between the right-hand guide plate 28 and distribution plate 29 and the scrap tray 26. The rinse pump 40 is connected to a source 50 of fresh hot water for rinse by means of a conduit $P_1$ and is driven by an integrally mounted electric motor (not shown) to supply the fresh hot water to the rinse arms 12a, 12b.

Assuming that the manual switch SW is closed in a condition where a desired amount of fresh hot water is stored in the wash tank 20 of washing chamber 10, the linear actuator 34 is activated to attract the movable rod 34a against the biasing force of coil spring 33. As a result, the rotary lever 32 is rotated counterclockwisely to displace the distribution plate 29 to the first position shown by imaginary lines in FIG. 2.

When the wash pump 60 is driven to pump up the hot water from the bottom of tank 20, the wash arms 11a, 11b are supplied with the hot water from pump 60 through conduits $P_4$ and rotate to spray jet streams of the hot water onto the racked dishes 14. After sprayed over the racked dishes 14, the hot wash water falls on the guide plates 27, 28 and is received by the distribution plate 29 to flow into the strainer box 25. In this instance, food scraps released from the dishes 14 are received by the filter 25b of strainer box 25, and the soiled wash water is drained outwardly through the drain and overflow pipe 24c, 22. Thus, the racked dishes 14 are prewashed by jet streams of the fresh hot water supplied to the wash arms 11a, 11b from pump 60. During the prewashing operation, the racked dishes 14 are warmed up by the heat of wash water, while the soiled wash water is discharged from the washing chamber 10. This is useful to maintain the fresh hot water in wash tank 20 at a proper temperature required for effective washing and to assure proper cleaning and sanitizing.

After the prewashing operation, the manual switch SW is opened to deactivate the linear actuator 34 so that the rotary lever 32 is rotated clockwisely under the biasing force of coil spring 33. As a result, the distribution plate 29 is displaced to the second position shown by solid lines in FIG. 2. In this instance, the remaining fresh hot water is supplied to the wash arms 11*a*, 11*b* during operation of the wash pump 60 and sprayed over the racked dishes 14. After sprayed, the hot water falls on the warmed guide plates 27, 28 and is received by the distribution plate 29 to flow into the wash tank 20 through the scrap tray 26. Thus, the hot wash water is circulated into the wash tank 20 and is supplied to the wash arms 11*a*, 11*b* to repeat the washing operation.

When the wash pump 60 has been stopped to finish the washing operation, the rinse pump 40 is driven to supply fresh hot water to the rinse arms 12*a*, 12*b* from the source of hot water 50. Thus, the racked dishes 14 are rinsed by jet streams of the fresh hot water applied thereto from the rinse arms 12*a*, 12*b*. After sprayed over the dishes 14, the hot rinse water falls on the warmed guide plates 27, 28 and is received by the distribution plate 29 to flow into the wash tank 20 through the scrap tray 26. In this instance, the scrap tray 26 will receive and retain a small amount of released food scraps thereon. When the wash tank 20 is filled with the hot rinse water, the overflow pipe 22 will permit the flow of excessive rinse water drained therethrough. When the rinse pump 40 has been stopped to finish the rising operation, the hot rinse water in the wash tank 20 can be utilized as the wash water for the following washing operation. This is useful to reduce comsuption of the hot water and to enhance efficiency of the washing operation at the proper temperature. When it is desired to remove the food scraps accumulated in the strainer box 25 and scrap tray 26, the guide plates 27, 28 are released at their fastened flanges 27*c*, 28*c* and moved upward to take out the strainer box 25 and scrap tray 26.

Figure 4:
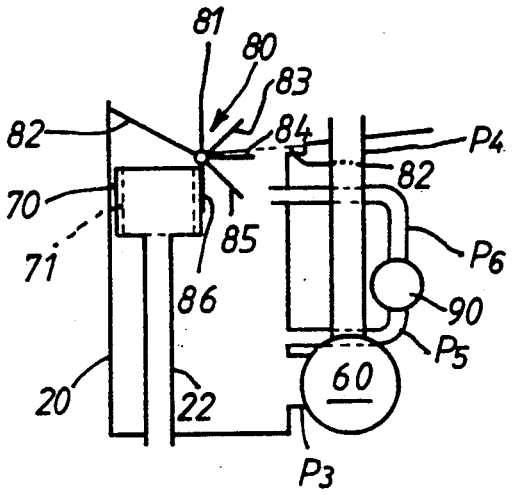
FIG. 4 is a schematic illustration of another embodiment of the present invention.

In FIG. 4 there is illustrated another embodiment of the present invention, wherein the support plate 24 and strainer box 25 are replaced with a strainer box 70, and wherein the guide plates 27, 28 and distribution plate 29 are replaced with an impeller 80. In this embodiment, the strainer box 70 is mounted in place within the upper portion of wash tank 20 and connected to the upper end of overflow pipe 22 to permit the flow of soiled wash water drained therefrom through the overflow pipe 22. The strainer box 70 is provided therein with a box-like filter 71 which is arranged to receive and retain thereon food scraps released from the racked dishes 14 during the washing operation. The impeller 80 includes a support shaft 81 located along the right-hand upper end of strainer box 70 and being rotatably mounted within the wash tank 20, a distribution plate 82 fixed at its base end to the support shaft 81 to cover the strainer box 70, and a plurality of circumferentially spaced radial blades 83–86 fixed at their base ends to a front end portion of support shaft 81 adjacent the distribution plate 82. The distribution plate 82 is loaded by a spring (not shown) to be maintained in engagement with the left-hand side wall of wash tank 20. The radial blades 83–86 are arranged to rotate in a space between the front wall of wash tank 20 and a front wall of strainer box 70.

When placed in a first position shown by a solid line in FIG. 4, the distribution plate 82 covers over the the strainer box 70 and receives the sprayed wash water thereon to introduce it into the wash tank 20. When the radial blades 83–86 are rotated clockwisely by wash water under pressure applied thereto, the distribution plate 82 rotates with the radial blades to open the strainer box 70 and to close an opening between the strainer box 70 and the right-hand side wall of wash tank 20. To apply the wash water under pressure to the radial blades of impeller 80, a pump 90 is connected at its inlet to a bottom portion of wash tank 20 by means of a pipe $P_5$ and at its outlet to an upper portion of wash tank 20 by means of a pipe $P_6$ to direct jet streams of the fresh wash water under pressure toward the radial blades of impeller 80.

Assuming that the pump 90 is driven during the prewashing operation of the dishwashing machine, the radial blades of impeller 80 are applied with the wash water under pressure from pipe $P_6$ to rotate the distribution plate 82 clockwisely. Thus, the distribution plate 82 is positioned to receive the soiled wash water thereon and introduce it into the strainer box 70. In this instance, food scraps released from the racked dishes 14 are received by the filter 71 in strainer box 70, and the soiled wash water is drained outwardly through the overflow pipe 22. When the pump 90 is stopped after the prewashing operation, the distribution plate 82 is returned to the first position under load of the spring applied thereto to cover the strainer box 70. Thus, the sprayed wash water is received by the distribution plate 82 and flows into the wash tank 20 to be recirculated to the wash arms 11*a*, 11*b* through the wash pump 60.

Figure 5:
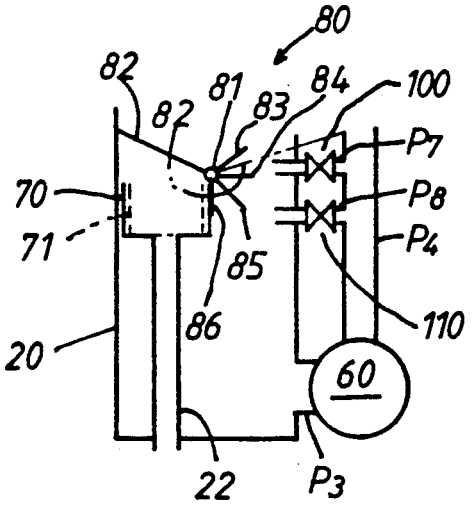
Figure 7:
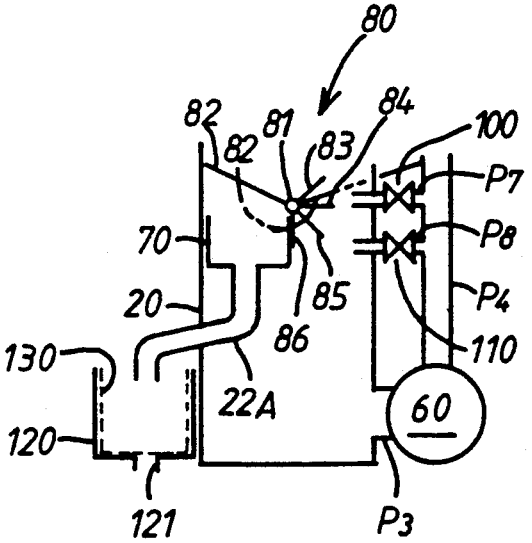

The embodiment of FIG. 4 may be modified as shown in FIG. 5, wherein the pump 90 and pipes $P_5$, $P_6$ are replaced with manually operated valves 100 and 110 which are provided on bypass pipes $P_7$ and $P_8$, respectively. In this modification, the bypass pipes $P_7$, $P_8$ are connected at their one ends to the wash water supply conduit $P_4$ in connection to the wash pump 60 and open at their other ends into the upper portion of wash tank 20. The upper radial blade 83 of impeller 80 is arranged to rotate counterclockwisely when applied with wash water under pressure from the upper bypass pipe $P_7$, while the lower radial blade 85 of impeller 80 is arranged to rotate clockwisely when applied with wash water under pressure from the lower bypass pipe $P_8$.

During the prewashing operation of the dishwashing machine, the upper valve 100 is closed, while the lower valve 110 is opened to apply the fresh wash water from pump 60 to the lower radial blades 85, 86. Thus, the impeller 80 is rotated clockwisely by the pressure of wash water applied thereto so that the distribution plate 82 is positioned to receive the soiled wash water and introduce it into the strainer box 70. In this instance, food scraps released from the racked dishes 14 are received by the filter 71 in strainer box 70, and the soiled wash water is drained outwardly through the overflow pipe 22. After the prewashing operation, the lower valve 110 is closed, while the upper valve 100 is opened to apply the fresh wash water from pump 60 to the upper radial blade 83 of impeller 80. Thus, the impeller 80 is rotated counterclockwisely by the pressure of fresh wash water applied thereto so that the distribution plate 82 is returned to the first position to receive the sprayed wash water and introduce it into the wash tank 20.

Figure 6:
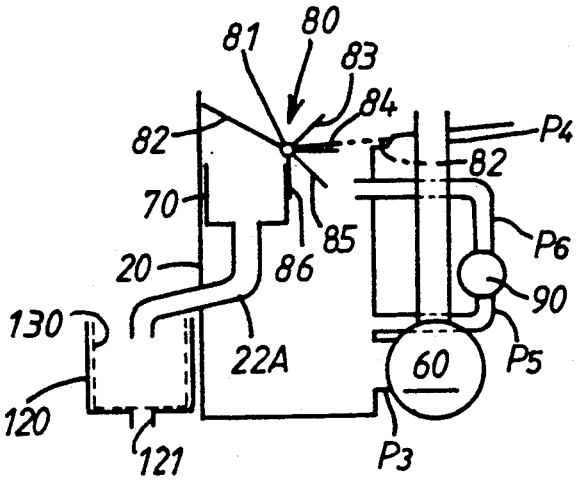
FIGS. 5–7 each illustrate a modification of the embodiment shown in FIG. 4.

The embodiment of FIG. 4 may be further modified as shown in FIG. 6, wherein the filter 71 is removed from the strainer box 70 and the overflow pipe 22 is extended outwardly through the left-hand side wall of wash tank 20 as indicated at 22A. In this modification, a strainer box 120 is detachably mounted to the left-hand side wall of wash tank 20 to receive the soiled wash water drained from the overflow pipe 22A. The strainer box 120 is provided at its bottom with a drain pipe and therein with a box-like filter for receiving food scraps released from the racked dishes 14. Similarly, the embodiment of FIG. 5 may be modified as shown in FIG.

7, wherein the overflow pipe 22 is extended outwardly through the left-hand side wall of wash tank 20 as indicated at 22A. The other construction is substantially the same as that of the modification shown in FIG. 6.

While several embodiments of the present invention have been shown and described in detail, it is to be recognized that various modifications and rearrangements may be resorted to without departing from the scope of the invention as defined in the appended claims.

What is claimed is:

1. A dishwashing machine including a washing chamber having a bottom, a wash tank formed at the bottom of said washing chamber to store an amount of hot wash water therein, a wash pump mounted to a bottom portion of said wash tank to pump up the hot wash water therefrom, and means for applying jet streams of the hot wash water supplied thereto from said wash pump over a rack of dishes placed in said washing chamber, characterized in that a strainer box is mounted within an upper portion of said wash tank to receive the wash water flowing down from the rack of dishes during washing operation and associated with a side wall of said wash tank to form an opening in communication with the bottom portion of said wash tank, said strainer box having a bottom in communication with a drain pipe to permit the flow of wash water drained outwardly therethrough, and that a distribution plate is arranged to receive the wash water and introduce it into said strainer box when placed in a first position and to receive the wash water and introduce it into the bottom portion of said wash tank through said opening when placed in a second position.

2. A dishwashing machine as claimed in claim 1, wherein a partition wall is provided within the upper portion of said wash tank in such a manner as to form a first opening in which said strainer box is arranged to receive the wash water flowing down from the rack of dishes and to form a second opening in communication with the bottom portion of said wash tank, a pair of guide plates are arranged above the first and second openings and extended downward toward said partition wall to receive the wash water and introduce it into the first and second openings, and said distribution plate is arranged to close the second opening when placed in the first position and to close the first opening when placed in the second position.

3. A dishwashing machine as claimed in claim 2, wherein a support plate is mounted within the first opening to support said strainer box thereon, and wherein said drain pipe is connected to said support plate for communication with the bottom of said strainer box and disposed into an overflow pipe in said wash tank.

4. A dishwashing machine as claimed in claim 2, wherin a scrap tray is detachably mounted within said second opening in communication with the bottom portion of said wash tank.

* * * * *